US006327748B2

(12) United States Patent
Stahlecker

(10) Patent No.: US 6,327,748 B2
(45) Date of Patent: Dec. 11, 2001

(54) APPARATUS OF A SPINNING MACHINE FOR CONDENSING A FIBER STRAND

(75) Inventor: Gerd Stahlecker, Eislingen/Fils (DE)

(73) Assignees: Fritz Stahlecker, Bad Überkingen; Hans Stahlecker, Süssen, both of (DE)

( * ) Notice: Subject to any disclaimer, the term of this patent is extended or adjusted under 35 U.S.C. 154(b) by 0 days.

(21) Appl. No.: 09/780,372

(22) Filed: Feb. 12, 2001

(30) Foreign Application Priority Data

Feb. 22, 2000 (DE) ..... 100 08 130

(51) Int. Cl.[7] ..... D01H 5/86
(52) U.S. Cl. ..... 19/246; 19/150; 57/315
(58) Field of Search ..... 19/150, 236–250, 19/252, 263, 286–288, 304–308; 57/264, 304, 315, 328, 333

(56) References Cited

U.S. PATENT DOCUMENTS 6,021,548 * 2/2000 Temburg ..... 19/150
6,073,314 * 6/2000 Barauke ..... 19/246
6,082,089 * 7/2000 Stahlecker ..... 57/315
6,108,873 8/2000 Barauke ..... 19/236
6,161,258 * 12/2000 Stahlecker ..... 19/286
6,170,126 * 1/2001 Stahlecker ..... 19/246
6,185,790 * 2/2001 Stahlecker ..... 19/246
6,209,303 * 4/2001 Stahlecker ..... 57/304

* cited by examiner

*Primary Examiner*—John J. Calvert
*Assistant Examiner*—Gary L. Welch
(74) *Attorney, Agent, or Firm*—Crowell & Moring LLP

(57) ABSTRACT

A condensing zone for condensing a drafted fiber strand is disposed downstream of a front roller pair of a drafting unit of a ring spinning machine. The condensing zone comprises a stationary sliding surface having a suction slit, over which the fiber strand is transported by an air-permeable transport belt. The condensing zone is bordered on its exit side by a nipping roller disposed on the transport belt. The nipping roller drives the transport belt and is in turn driven by the front pressure roller of the drafting unit. The front pressure roller is, for this purpose, connected with the nipping roller via a drive belt, preferably a toothed belt. The nipping roller and the front pressure roller are arranged on supporting arms which can be spread apart and which tension the drive belt.

14 Claims, 1 Drawing Sheet

APPARATUS OF A SPINNING MACHINE FOR CONDENSING A FIBER STRAND

BACKGROUND AND SUMMARY OF THE INVENTION

This application claims the priority of German Patent Document 100 08 130.4, filed Feb. 22, 2000, the disclosure of which is expressly incorporated by reference herein.

The present invention relates to an apparatus of a spinning machine for the drafting and subsequent condensing of a fiber strand, comprising a condensing zone located downstream of a front roller pair of a drafting unit, an air-permeable transport belt which transports the fiber strand through the condensing zone, a suction channel arranged at the condensing zone, which suction channel guides the transport belt over a sliding surface, a suction slit arranged in the sliding surface, a nipping roller which drives the transport belt and presses the fiber strand and the transport belt to the sliding surface at the end of the condensing zone, a top weighting arm of the drafting unit which top weighting arm supports the nipping roller and a front pressure roller of the front roller pair, and a drive belt which connects the front pressure roller with the nipping roller.

Important for the condensing of a fiber strand leaving a drafting unit is that the fiber strand is transported in the condensing zone disposed on an air-permeable transport element and still in a twist-free state and having fibers which lie essentially parallel to one another, and that in the condensing zone an air stream is generated which flows through the transport element, which air stream determines or assists the degree of condensing depending on its width and/or direction and which assists positioning of the fibers transversely to the transport direction so that the fiber strand is bundled or condensed. In the case of a fiber strand condensed in this way, a spinning triangle does not occur, so that the arising thread is more even, tear resistant and less hairy.

In the case of an apparatus of the above mentioned type (U.S. Pat. No. 6,108,873), the transport element is an air-permeable transport belt, which is driven by the nipping roller. A transfer belt (not described in detail) is provided as a drive belt for the nipping roller. The way in which the necessary tensioning of the drive belt is effected is left open here.

It is an object of the present invention to create for the apparatus of the above mentioned type, a suitable device comprising a drive belt for the nipping roller.

This object has been achieved in accordance with the present invention in that the nipping roller and the front pressure roller are arranged on holding arms which can be spread apart and which tension the drive belt.

Two holding arms are preferably provided for the nipping roller and the front pressure roller, which are joined together via a hinge joint, against which a weighting spring is pressed. By means thereof, the front pressure roller and the nipping roller can move apart when loaded and thus tension the drive belt.

If the drive belt is a toothed belt, not only does a clear ratio between the circumferential speeds of the nipping roller and the front pressure roller exist, but also in the case of the nipping roller jamming due to thread windings occuring, the toothed belt can skip over teeth on the drive wheels, so that, for example, a flexible coating of the nipping roller is not abraded.

The drive belt can be provided with a predetermined breaking point, so that the drive belt tears if the nipping roller jams.

Other objects, advantages and novel features of the present invention will become apparent from the following detailed description of the invention when considered in conjunction with the accompanying drawings.

DETAILED DESCRIPTION OF THE DRAWINGS

Figure 1:
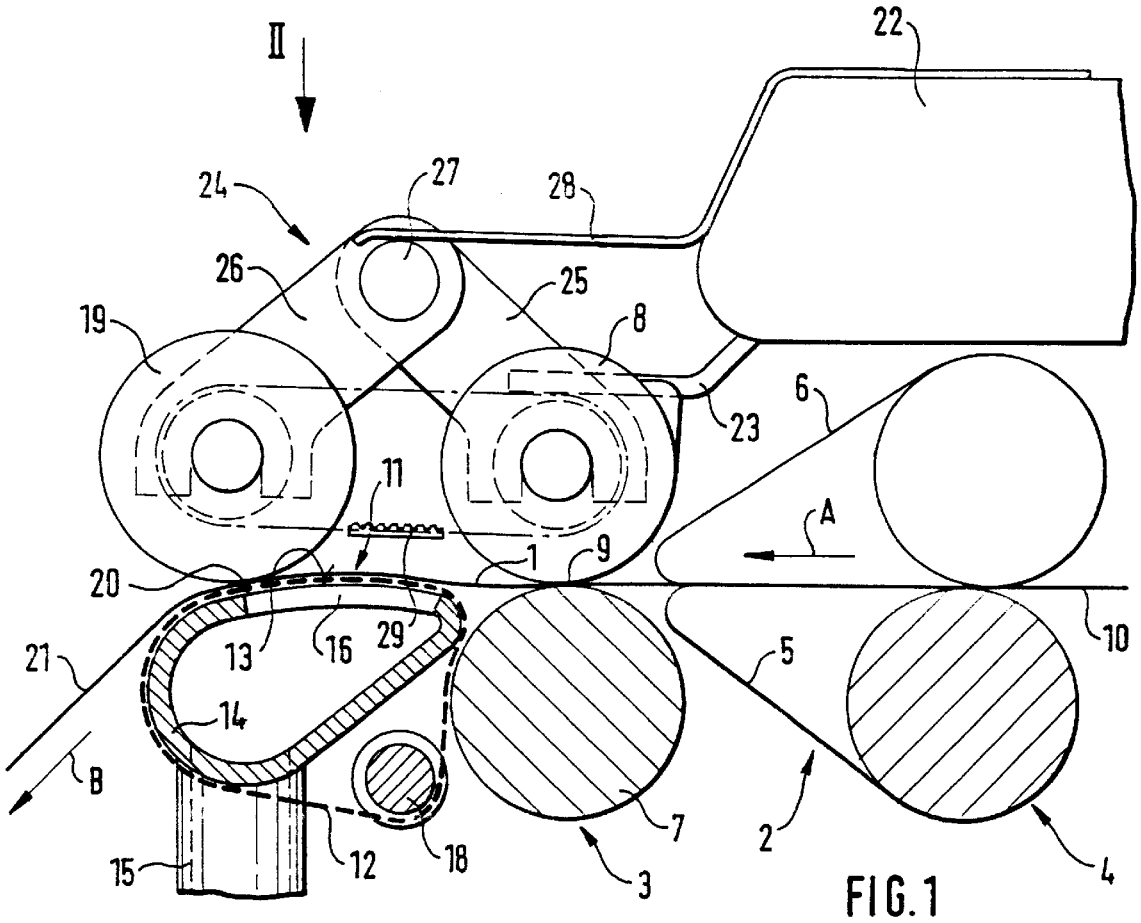
FIG. 1 is a partly sectional side view of an apparatus constructed according to preferred embodiments of the present invention.
Figure 2:
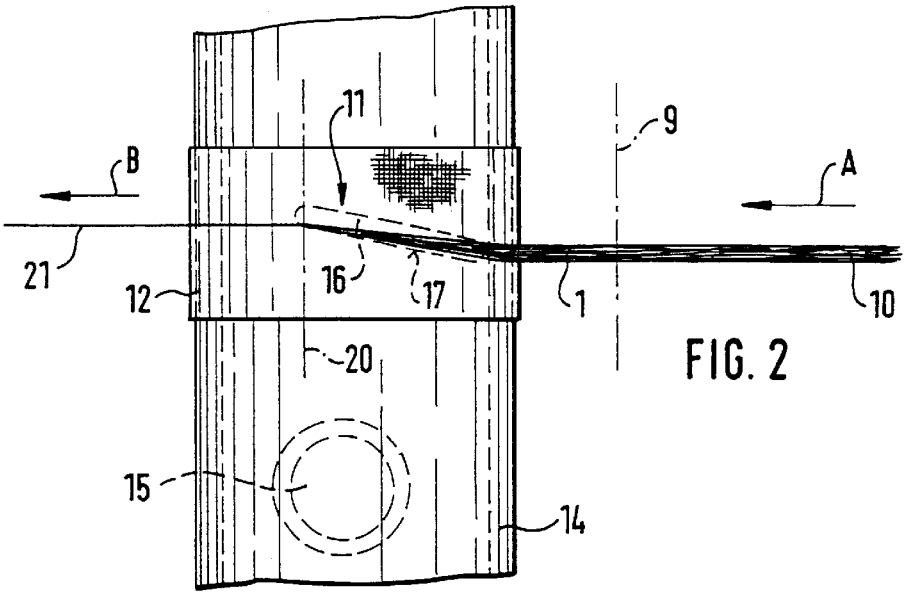
FIG. 2 is a view in the direction of arrow II of the FIG. 1 of the respective condensing zone.

Of a spinning machine, in particular a ring spinning machine, only the area of the apparatus according to the present invention is shown in FIGS. 1 and 2. This apparatus serves the drafting and subsequent condensing of a fiber strand 1. Of the drafting unit 2 itself only a front roller pair 3 as well as an apron roller pair 4 located upstream thereof having a bottom apron 5 and an upper apron 6 are shown. The front roller pair 3 comprises in a known way a driven bottom cylinder 7 as well as a front pressure roller 8 which is flexibly pressed against the bottom cylinder 7. The front roller pair 3 defines a front nipping line 9, at which the drafting zone of the drafting unit 2 ends. The drafting unit 2 serves in a known way to draft a sliver or roving 10 traveling in transport direction A. The drafting takes place to the desired degree of fineness.

A condensing zone 11 is located downstream of the drafting zone of the drafting unit 2. The condensing zone 11 has an air-permeable, preferably thin, fine-meshed woven belt as a transport belt 12, which transports the fiber strand 1 to be condensed through the condensing zone 11. The condensing zone 11 comprises further a sliding surface 13, which guides the transport belt 12 over the condensing zone 11. The sliding surface 13 is the outer contour of a part of a suction channel 14, which preferably extends over a plurality of spinning stations. The suction channel 14 is connected via a vacuum conduit 15 to a vacuum source (not shown).

A suction slit 16 is located in the sliding surface 13, over which suction slit 16 the fiber strand 1 is transported by the transport belt 12. The suction slit 16 is arranged slightly transversely to the transport direction A, and comprises thus a bundling edge 17, along which the fiber strand 1 runs during condensing.

At a distance from the suction slit 16, the transport belt 12 is tensioned by a tension element 18, for example a round rod or a roller. In close proximity to the tension element 18, the transport belt 12 comes at this point into contact with the bottom cylinder running in the opposite direction, whereby the transport belt 12 is cleaned of fiber fly.

At the end of the condensing zone 11, a nipping roller 19 presses the fiber strand 1 and the transport belt 12 against the sliding surface 13 and drives hereby the transport belt 12. The nipping roller 19 defines thus a delivery nipping line 20, which borders the condensing zone 11 on its exit side and at the same time forms a twist block for the spinning twist which is subsequently to be applied to the thread 21. For this the thread 21 travels in delivery direction B to a twist device, for example a ring spindle. Due to the delivery nipping line 20, the spinning twist cannot run back into the condensing zone 11.

The nipping roller 19 as well as the front pressure roller 8 are arranged on a top weighting arm 22, which supports in a known way also the remaining pressure rollers (not shown)

of the drafting unit 2. The front pressure roller 8 is hereby weighted by a pressure spring 23 with a relatively strong force, so that the necessary drafting forces of the drafting unit 2 can be applied at the front nipping line 9.

A holding device 24, which comprises two pincer-like holding arms 25 and 26 arranged hinged to one another, holds the nipping roller 19 and the front pressure roller 8. The holding arms 25, 26 are joined by means of a hinge joint 27, against which a weighting spring 28, arranged on the top weighting arm 22, presses. The necessary, relatively light pressure of the nipping roller 19 against the suction channel 14 is achieved.

The nipping roller 19 is driven at a circumferential speed which is slightly higher than the circumferential speed of the front pressure roller 8. The differences in the two speeds is just such that in the condensing zone 11, a low tension draft is exerted on the fiber strand 1, which prevents the fibers wrinkling. The nipping roller 19 is driven hereby by the front pressure roller 8, namely via a drive belt 29, which is advantageously in the form of a toothed belt. When the weighting spring 28 presses against the hinge joint 27, the holding arms 25 and 26 are spread apart, and the drive belt 29 is held taut.

When a condensing zone 11 is present—in what is commonly known as so-called condensing spinning—it can happen that fiber windings occasionally occur at the nipping roller 19. These result in the nipping roller 19 being jammed and can lead to abrading of the flexible coating of the nipping roller 19. If the drive belt 29 has the revelant form, the jamming of the nipping roller 19 does not result in the above mentioned disadvantages. In the case of a toothed belt form, the teeth are, for example, capable of skipping over onto their driven or driving wheels. In addition, the drive belt 29 can be provided with a predetermined break point, so that in the case of a winding forming at the nipping roller 19, the drive belt 29 tears.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Apparatus of a spinning machine for the drafting and subsequent condensing of a fiber strand, comprising a condensing zone located downstream of a front roller pair of a drafting unit, an air-permeable transport belt which transports the fiber strand through the condensing zone, a suction channel arranged at the condensing zone, which suction channel guides the transport belt over a sliding surface, a suction slit arranged in the sliding surface, a nipping roller which drives the transport belt and presses the fiber strand and the transport belt to the sliding surface at the end of the condensing zone, a top weighting arm of the drafting unit, which top weighting arm supports the nipping roller and a front pressure roller of the front roller pair, and a drive belt which connects the front pressure roller with the nipping roller, wherein the nipping roller and the front pressure roller are arranged on holding arms which can be spread apart and which tension the drive belt, and wherein the holding arms are connected to one another by a hinge joint, against which a weighting spring is pressed.

2. Apparatus according to claim 1, wherein the drive belt is a toothed belt.

3. Apparatus according to claim 2, wherein a separate pressure spring, which generates a nipping pressure at the front roller pair, is arranged at least the front pressure roller.

4. An apparatus according to claim 2, wherein the drive belt is provided with a predetermined breaking point.

5. Apparatus according to claim 1, wherein a separate pressure spring, which generates a nipping pressure at the front roller pair, is arranged at least the front pressure roller.

6. An apparatus according to claim 5, wherein the drive belt is provided with a predetermined breaking point.

7. An apparatus according to claim 1, wherein the drive belt is provided with a predetermined breaking point.

8. An assembly for driving a nipping roller which is drivingly engageable with a perforated fiber strand transport belt at a downstream end of a condensing zone arranged downstream of a front pressure roller of a drafting unit, comprising:

a drive belt operable to connect the front pressure roller and the nipping roller, and holding arms for the respective front pressure roller and nipping roller, said holding arms being movable in part during use thereof to tension the drive belt, and wherein the holding arms are connected to one another by a hinge joint, against which a weighting spring is pressed.

9. Apparatus according to claim 8, wherein the drive belt is a toothed belt.

10. An apparatus according to claim 9, wherein the drive belt is provided with a predetermined breaking point.

11. An apparatus according to claim 10, wherein a separate pressure spring, which generates a nipping pressure at the front roller pair, is arranged at least the front pressure roller.

12. An apparatus according to claim 8, wherein the drive belt is provided with a predetermined breaking point.

13. An apparatus according to claim 12, wherein a separate pressure spring, which generates a nipping pressure at the front roller pair, is arranged at at least the front pressure roller.

14. An apparatus according to claim 8, wherein a separate pressure spring, which generates a nipping pressure at the front roller pair, is arranged at at least the front pressure roller.

* * * * *